United States Patent [19]

Barrett

[11] 4,422,381

[45] Dec. 27, 1983

[54] IGNITER WITH STATIC DISCHARGE ELEMENT AND FERRITE SLEEVE

[75] Inventor: Joseph A. Barrett, Collegeville, Pa.

[73] Assignee: ICI Americas Inc., Wilmington, Del.

[21] Appl. No.: 96,080

[22] Filed: Nov. 20, 1979

[51] Int. Cl.[3] ..... F42B 3/10

[52] U.S. Cl. ..... 102/202.2; 102/202.4; 102/202.8; 102/202.12; 102/202.14; 102/202.5

[58] Field of Search ..... 102/202.2, 202.3, 202.4, 102/202.8, 202.9, 202.12, 202.14, 204, 202.5

[56] References Cited

U.S. PATENT DOCUMENTS

| | | | |
|---|---|---|---|
| 2,086,532 | 10/1935 | Burrows . | |
| 2,977,878 | 4/1961 | Kinkel et al. | 102/28 R |
| 3,180,263 | 4/1965 | Williams, Jr. . | |
| 3,306,202 | 2/1967 | Menichelli et al. | 102/202.14 X |
| 3,333,538 | 8/1967 | Schnettler . | |
| 3,420,174 | 1/1969 | Potter | 102/28 R |
| 3,426,682 | 2/1969 | Corren et al. | 102/28 R |
| 3,638,811 | 8/1972 | Driscoll . | |
| 3,753,403 | 8/1973 | Menichelli | 102/28 R |
| 3,789,403 | 8/1973 | Petrick | 102/28 R |
| 3,789,762 | 2/1974 | Petrick | 102/202.4 |
| 3,804,018 | 4/1974 | Janoski | 102/202.3 |
| 3,831,523 | 8/1974 | Thomas et al. | 102/202.14 X |
| 3,971,320 | 7/1976 | Lee | 102/28 R |
| 3,988,989 | 11/1976 | Shea | 102/28 R |
| 3,999,484 | 12/1976 | Evans | 102/28 R |
| 4,271,453 | 6/1981 | Yajima et al. | 102/202.3 X |
| 4,306,499 | 12/1981 | Holmes | 102/202.4 |

FOREIGN PATENT DOCUMENTS

| | | | |
|---|---|---|---|
| 581316 | 8/1959 | Canada | 102/28 R |
| 768486 | 2/1957 | United Kingdom . | |
| 2018959 | 10/1979 | United Kingdom . | |

*Primary Examiner*—Peter A. Nelson

*Attorney, Agent, or Firm*—Louis F. Kreek, Jr.

[57] ABSTRACT

Electroexplosive device and static discharge element therefor. The electroexplosive device herein has a cylindrical metallic casing which is open at one end and closed at the other end, a bridge element and lead wires therefor, a static discharge disc surrounding the lead wires for preventing accidental ignition due to static electricity, and a ferrite sleeve surrounding the lead wires to prevent accidental initiation due to radio frequency currents. The static discharge element comprises a nonconductive circular substrate having a slotted opening for the lead wires, and a conductive coating layer on at least one face of the substrate to conduct electricity from the leads to the casing in the event of electrostatic discharge. This conductive layer should be in electrical contact with the casing but not with the lead wires; to that end the substrate is left uncoated in the immediate vicinity of the opening. The ferrite sleeve is in electrical contact with the casing through a solder layer but is electrically insulated from the lead wires by a nonconductive thermal plastic material.

9 Claims, 6 Drawing Figures

IGNITER WITH STATIC DISCHARGE ELEMENT AND FERRITE SLEEVE

BACKGROUND OF THE INVENTION

1. Field of the Invention

This invention relates to electroexplosive devices and more particularly to an electroexplosive device (EED) which is useful in automotive airbags.

The term, "electroexplosive device" (or EED) herein refers to any electrically initiated explosive or pyrotechnic device. Such devices include, for example, squibs, initiators, electric initiators, electric detonators, and electrically initiated matches.

2. Description of the Prior Art

Airbags have been suggested as a means for protecting passengers of automobiles and other vehicles from injury due to striking a part of the vehicle (such as the windshield or dash board) in the event of rapid deceleration, which may occur in the event of a crash. An advantage of the airbag over other passenger restraint devices, such as seat belts, is that the airbag is initiated automatically by rapid deceleration and does not require any action on the part of a passenger (such as fastening a seat belt).

The rapid action required for inflating an airbag is best provided by an EED. However, either static electricity, radio frequency (RF) waves or both, may be present in the vicinity of an automobile. Either one is capable of accidental initiation of an EED. U.S. Pat. No. 3,414,292 to Oldberg et al. shows an airbag initiated by an EED and having means located externally of the EED for preventing accidental initiation by radio frequency (RF) currents. Provision of means for preventing accidental RF initiation is essential in EED's used in automobiles.

An EED having both a ferrite plug located inside the casing for protection against RF discharge, and means (a resistor) for preventing accidental electrostatic discharge, is shown in U.S. Pat. No. 3,264,989 to Rucker.

Numerous patents illustrate EED's containing a static discharge element in the form of a semiconductive plug, or "static shunt mix," consisting of metal powder such as alumina dispersed in a nonconductive binder such as wax or polyethylene. Such EED's are shown for example in U.S. Pat. Nos. 2,658,451 to Horne, 2,802,421 to Horne et al., and 3,194,160 to Spillane et al. A semiconductive plug presents a conductive discharge path for high voltage discharges and a high resistance path for the low voltages normally used to fire EED's. Disadvantages of semiconductive mixes are twofold. First of all, dielectric strength and insulation resistance are relatively low and variable. The second disadvantage is that the static discharge mix is of paste consistency and must be introduced into the EED in precise amounts, which is difficult and expensive because of the small sizes of most EED's.

Another type of static shunt device is shown in U.S. Pat. No. 3,333,538 to Schnettler. This patent shows a thin nonconductive plastic sheet having a plurality of conductive hexagon-shaped areas, separated by spark gaps formed by the uncoated spaces between the hexagons. The hexagons are dimensioned so that one gap is always provided between each lead wire and the shell, and so that there is always at least one gap between the lead wires. The plastic sheet is pierced by the lead wires during assembly, which results in firm electrical contact between the lead wires and the conductive areas on the sheet. One disadvantage of the Schnettler structure is that the sheet must be oriented during assembly so that the rows of hexagons are parallel to the line connecting centers of the lead wires. Another disadvantage is there is some danger of bending the lead wires during assembly, because no clearance is provided between the leads and the sheet. Another disadvantage is that the leads must be straight at the time of assembly of the static shunt device. Also, the distance between lead wires must equal or exceed the distance from either lead wire to fthe casing.

Another type of static discharge device is illustrated in U.S. Pat. No. 3,789,762 to Petrick. This static discharge device comprises a tab of metallic foil which is connected to the metallic casing of the EED and which has a pair of points that are in proximity with the lead wires of the EED. This structure provides a pair of spark gaps from each of the lead wires to the metal foil. Proper operation of this device depends on precise control of spark gap distances, so that currents induced by static electricity will jump across the spark gaps from the leads to the metal foil. However, because of the small size of most EED's and the flexible nature of the metal foil, it is difficult to achieve uniform spark gaps. Either a slight departure from the desired or nominal spacing of the lead wires, or a slight bending of the points, may cause the spark gap distance to increase substantally and thereby reduce the protection offered by the device.

U.S. Pat. No. 4,061,088 to Ueda discloses an EED containing a nonlinear resistor element which prevent ignition in the event of a static discharge.

Although numerous static discharge devices are known in the art, none to date has all properties desired in a static discharge element, such as low cost and ease of assembly, high dielectric strength, and high degree of reliability.

SUMMARY

In accordance with this invention, there is provided an electroexplosive device comprising an electrically conductive casing having an opening therein, a heat-ignitable charge in the casing, means for igniting said charge including a bridge element in proximity with the charge and conductor means for supplying an electric current to the bridge element, means for preventing accidental electric discharge of the device, and means inside the casing for preventing accidental radio frequency (RF) discharge.

The preferred means for preventing accidental electrostatic discharge is a static discharge disc comprising a nonconductive substrate having a central opening to permit the lead wire or wires to extend therethrough, and a thin electrically conductive layer covering a portion of at least one face of the substrate. The conductive layer is in electrical contact with the casing but is out of electrical contact with the lead wire (or wires) having an inner boundary disposed in proximity with but entirely out of contact with the adjacent edge of the opening, whereby a spark gap is provided between the lead wires and the conductive member.

Preferred means for protecting the device against accidental RF initiation is a ferrite sleeve having opening means (in the form of one or more openings) extending longitudinally therethrough for the lead wire (or wires), means for insulating the sleeve from the lead wire (or wires), and means for providing electrical contact between the sleeve and the casing.

THE DRAWINGS

DESCRIPTION OF PREFERRED EMBODIMENTS

Figure 1:
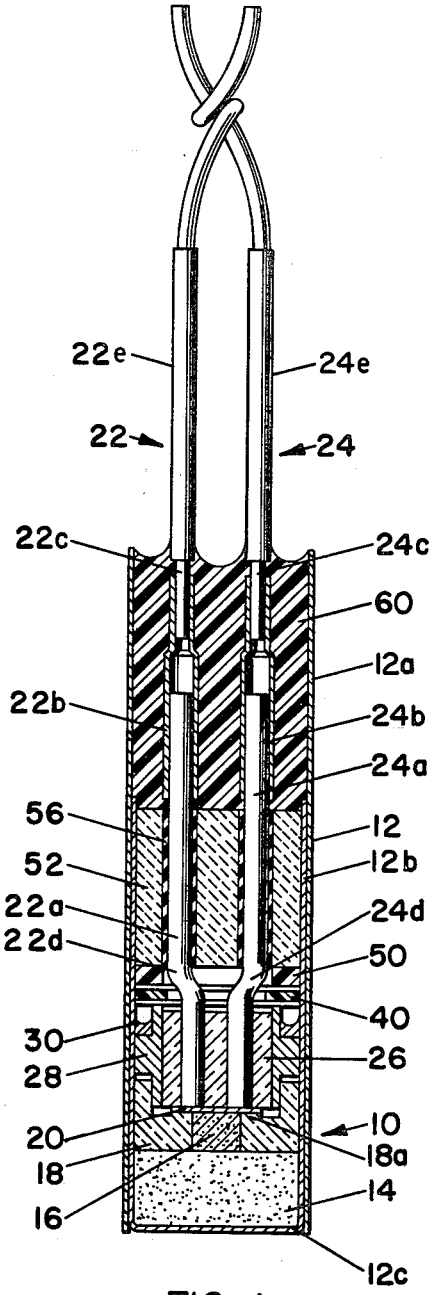
FIG. 1 is a longitudinal sectional view of an igniter according to a preferred embodiment of this invention.
Figure 2:
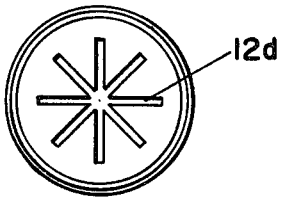
FIG. 2 is an end view of the casing of the igniter shown in FIG. 1.

The preferred electroexplosive device according to this invention is an igniter as shown in FIGS. 1 and 2.

Referring to FIG. 1, 10 is an igniter having a conductive casing 12 which has an opening therein. Casing 12 is preferably a cylindrical metallic casing which is open at one end and closed at the other end. Casing 12 is formed by cylindrical metal sleeve 12*a* and a cup-shaped metallic member comprising a cylindrical wall 12*b* which is press fit inside sleeve 12*a*, and a circular end wall 12*c* which closes one end of casing 12. End wall 12*c* is scored with a plurality of diametric grooves 12*d* (four are shown in FIG. 2), so that the end wall will assume a petal configuration and avoid fragmentation when the device is fired.

The components of EED 10 which are located inside casing 12 will be described in the order in which they are located in the assembled device, beginning at the closed end and proceeding toward the open end of the casing.

A base charge 14 of powdered igniter material, preferably a titanium/potassium perchlorate mixture, is located inside casing 12 adjacent the closed end thereof. Next to the base charge 14 is a heat ignitable charge 16 and charge holder 18 therefor. The heat ignitable charge 16 is preferably pressed barium styphnate but may be another heat ignitable material which in combustion liberates enough heat to ignite the base charge 14. The charge holder 18 is an annular plastic member, preferably made of glass-filled nylon. The central opening of charge holder 18 contains the ignition charge 16, and the outer wall abuts the casing 12. Charge holder 18 has a shoulder 18*a*.

The electroexplosive device 10 is provided with means for igniting ignition charge 16 including a bridge element 20 and conductor means (shown as conductors 22, 24) including leads 22*a*, 24*a* for supplying an electric current to the bridge element 20. Bridge element 20 is in proximity with the ignition charge 16 and the shoulder 18*a*. Bridge element 20 may consist of either one or two wires connecting the ends of lead wires 22*a*, 24*a*. The use of two bridge wires instead of one reduces the chance that there will be no operative wire. Leads 22*a*, 24*a* extend longitudinally from bridge element 20 toward the open end of casing 12. Conductors 22, 24 also include metallic connectors 22*b*, 24*b* in the form of sleeves, and external wires 22*c*, 24*c*, respectively, The leads 22*a*, 24*a* are bent at 22*d* and 24*d* in order to provide enough space to prevent short circuiting between connectors 22*b* and 24*b* while maintaining the leads close enough together at the bottom so that the bridge element 20 will have the desired characteristics. External wires 22*c*, 24*c* extend through the open end of casing 12. External wires 22*c*, 24*c* may be covered by insulation 22*e*, 24*e*.

Surrounding lead wires 22*a*, 24*a* are a glass plug 26 and concentric metal header 28. The middle portion of the outer wall of header 28 abuts the inner wall of casing 12. The end portions of the outer wall are of smaller radius than the middle portion, to provide fitting engagement with the charge holder 18 and to provide a recess for a ring 30 of solder material. The inner wall of header 28 abuts glass plug 26. A glass-to-metal seal is formed between the glass plug on the one hand and the leads 22*a*, 24*a* and the header 28 on the other. The base charge 16, charge holder 18, bridge element 20, leads 22*a*, 24*a*, glass plug 26 and header 28 are preferably formed into an ignition assembly prior to assembly of the complete electroexplosive device 10.

A static discharge disc 40 rests on the upper end of header 28. Static discharge disc 40 harmessly dissipates currents which are due to static electricity. The static discharge disc 40 will subsequently be described in detail with reference to FIGS. 3 and 4.

A nonconductive separator 50, of suitable plastic material such as polytetrafluoroethylene, is placed above the static discharge disc 40 to separate the disc from ferrite sleeve 52.

A ferrite sleeve 52 surrounding the lead wires is disposed above the separator 50. Ferrite sleeve 52 has opening means comprising one or more openings (one for each lead). The sleeve 52 has two openings in the preferred embodiment shown. A thin layer or coating 56 of a thermoplastic insulating material, such as polymonochloroparaxylylene, is applied to the insides of these openings, preferably by vacuum deposition, in order to provide insulation between the sleeve 52 and the lead wires 22*a* and 24*a* passing there through. An electrically conductive solder layer is placed between the outside diameter of sleeve 52 and the inside wall of casing 12 in order to provide good electrical contact between the ferrite sleeve 52 and the casing 12.

A mass 60 of waterproof nonconductive sealing material closes the open end of the casing 12. A conventional two-part epoxy resin may be used as the sealing material.

The static discharge disc 40 will now be described with reference to FIGS. 7 and 8. The details of the static discharge disc do not form a part of the present invention, but are described and claimed in the copending application of Donald M. Stonestrom, filed of even date herewith and entitled Static Discharge Disc.

Figure 3:
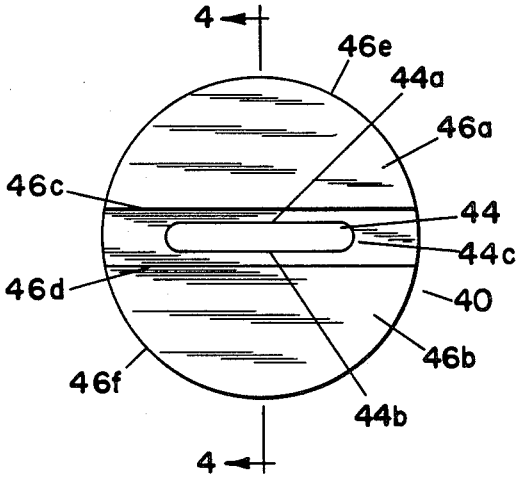
FIG. 3 is a plan view of a static discharge disc employed in the igniter of FIG. 1.
Figure 4:
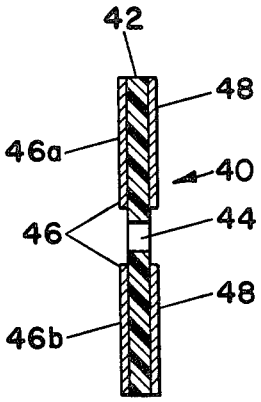
FIG. 4 is a sectional view of the static discharge disc shown in FIG. 3, taken along line 4–4.

Referring to FIGS. 3 and 4, static discharge disc 40 has a nonconductive circular substrate 42 which is preferably made of phenolic printed circuit board material. Other rigid substrate materials can be used. The substrate 42 includes an opening or slot 44 of oblong shape, having opposed parallel sides 44*a*, 44*b*, and semicircular end portions 44*c*. The slot 44 is preferably centered so that the parallel sides 44*a*, 44*b* lie at approximately equal distances from a diameter of disc 40. The width of the slotted opening 44 (i.e., the distance between parallel sides 44*a* and 44*b*) is slightly greater than the diameters of lead wires 22*a*, and 24*a*. Portions of both faces of substrate 42 are coated with electrically conductive layers 46, 48, preferably of copper. Layers 46 and 48 are identical, and so only one such layer 46 will be described in detail. Conductive layer 46 has two portions 46*a*, 46*b* of the same side and shape, each in the shape of a segment of a circle, and separated from each other by a nonconductive portion of the substrate. Portions 46*a* extends from its inner boundary 46*c*, which is a straight line parallel to and in proximity with, but spaced from, edge 44*a* of opening 44, to outer boundary 46*e*, which lies along the circumference of disc 40. Likewise, the electrically conductive portion 46*b* extends from its inner boundary 46*d*, which is a straight line close to but spaced from the edge 44*b* of opening 44, to its outer boundary 46*f* along the circumference of the disc 40. The portion of substate 42 between the two conductive portions 46*a* and 46*b* is uncoated and therefore nonconductive. To avoid short circuiting in the event that either lead wire of the EED touches either edge 44*a* or 44*b* of the slotted opening 44, it is important that the inner boundaries 46*c* and 46*d* of the conductive portions not be in contact with any portion of the edge of opening 44. It is not necessary for the outer boundaries 46*e*, 46*f* of the respective conductive portions 46*a*, 46*b* to lie along the circumference of disc 30, provided the shape of the conductive areas is such as outer boundaries are close enough to the circumference of the disc to provide an electrical connection between these conductive areas and the casing 12. As will be seen in FIG. 1, electrical contact between these conductive areas and casing 12 is afforded through conductive header 28.

The preferred static discharge disc 40 is coated with electrically conductive layers on both sides so that it will not be necessary to place the disc in any particular orientation during assembly of the EED 10. The static discharge disc can be provided with an electrically conductive layer on one side only if desired; however, in that case it is necessary during assembly of an EED to be sure that the side having the conductive layer is placed face down so that the conductive layer will be in registry with the conductive header 28 in the assembled device.

Figure 5:
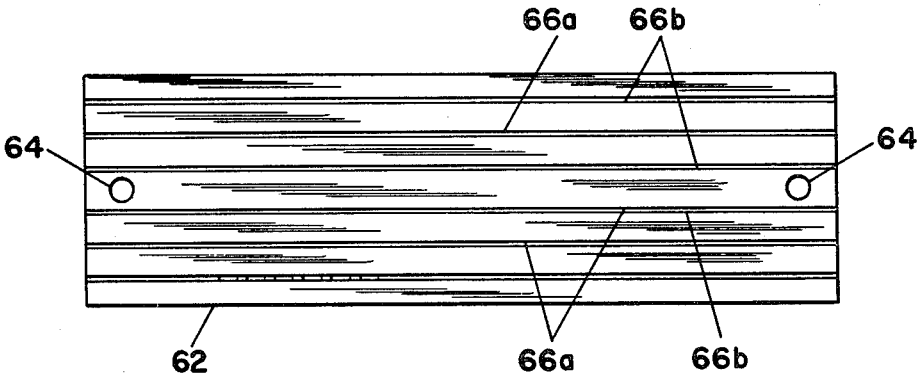
FIG. 5 is a plan view of a sheet of copper-coated printed circuit board from which static discharge discs shown in FIG. 3 are formed.
Figure 6:
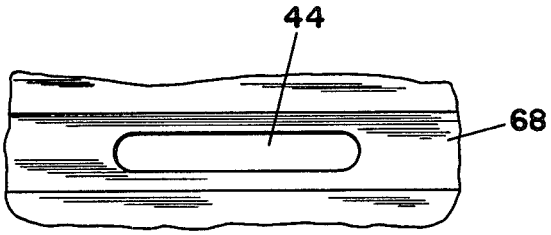
FIG. 6 is a fragmentary plan view of a portion of the sheet shown in FIG. 5.

The preparation of static discharge discs 40 may be illustrated with reference to FIG. 5. A rectangular sheet typically 4 ft by 8 ft. of commercial printed circuit board material comprising a non-conductive (e.g. phenolic resin) substrate which is copper clad on both sides, is sheared in to rectangular strips 62, which are typically 3 inches by 18 inches. Two holes 64 are punched near either end of the strip 62 and midway between the two long sides. These holes are used as reference holes for die sets and feeding mechanisms. Next, a plurality of oblong slots 44 aligned in rows are punched. A punch press having a die which will form the desired oblong slots is used. All slots may be punched at one time; however, where required by limitations in the punch press or die, one may punch three rows at a time, turn the strip around, and punch the other three rows. Also, one may punch the holes over a length of several inches, advance the strip, and so on until the entire length of the strip has been punched. It is possible to obtain very precise spacing of slots and alignment of rows in this manner. Next, copper is removed by known etching techniques to form six rows 68 in which copper has been removed. These rows are aligned with and slightly wider than the slots 44. Precise positioning of these rows 68, and removal of all copper from the sides of slots 44, can be achieved through use of the two reference holes 64. After removal of the copper from these rows, the work piece 62 is once again placed in a punch press, clamped at 64, and the static discharge discs are punched out with a circular punch.

The method of preparing static discharge discs described herein has pronounced advantages over other methods previously tried for making static discharge discs. The present method is suitable for large scale production of static discharge discs, the areas of bare substrate may be precisely aligned with the holes 44 so that there is no danger that copper will touch the edges of the slot, and the reject rate is quite low. The use of etching instead of other techniques for removing copper, such as miling is a particularly important factor in obtaining the required precise alignment of the rows of bare substrate with the rows of oblong slots.

The present invention will now be described with reference to a specific embodiment thereof. This specific embodiment is constructed in accordance with the drawings herein, having a length not exceeding 1.1 inch (2.8 cm) and having a diameter of 0.3 inch (0.76 cm). The base charge consists of 90 mg of titanium/potassium perchlorate mixture pressed at 5,000 psig. The ignition charge consists of 9 mg. of barium styphnate, having a moisture content not over 0.5%, which is pressed at 25,000 psig. Lead wires 22*a*, 24*a* and 0.04 inch (0.1 cm) in diameter. The static discharge disc is 0.26 inch in diameter, 0.032 inch thick (including the copper layers on either side, each of which is about 0.0004 inch thick), with a slot width of 0.042 inch and a copper-free substrate width of 0.051 inch.

The EED of the present invention is particularly useful as the initiator or passive restraint devices, popularly known as airbags, for automobiles. The EED may be used to ignite a heat generating cartridge which imparts additional energy to a stored gas source which inflates the airbag. One of the requirements for an EED in this service is that the EED shall not function when subjected to the discharge from a 500 picofarad capacitor charged to 25,000 volts, the discharge being applied through the leads (which are connected together) to the casing through a series resistance of 5,000 ohms. Electroexplosive devices according to this invention are capable of meeting that requirement.

The static discharge disc of FIGS. 3 and 4 offers major advantages over prior art structure for dissipating static charges.

A major advantage of the static discharge disc herein is a high degree of reliability. The gap between the edges 44*a*, 44*b* of the slot 44 and the adjacent boundaries 46*c*, 46*d* of the copper-covered area of the disc assures that there will always be a spark gap between the lead wires 22*a*, 24*a* and the copper-covered area, even when the lead wires touch an edge of the slot. At the same time, the spark gap between the lead wires and the copper-covered area will never be to large for effective operation, because the disc can be formed to close tolerances and is virtually incapable of incorrect assembly (other than to place the wrong side in contact with metal sleeve 28 when a disc which is copper covered on only one side is used).

The static discharge disc herein also has high dielectric strength and insulation resistance.

Another advantage of the present static discharge disc is that assembly of such a disc into an EED is both easy and fool proof. The slight clearance between the edges of opening 44 and the lead wires permits easy assembly, yet does not effect the reliability of the disc.

Another advantage of the static discharge disc herein is that it can be used with a wide variety of EED's. In other words, the static discharge disc does not impose any significant structural limitations on the EED.

Another advantage of the static discharge disc is that it is a solid member and can therefore be assembled into an EED more easily than can be the paste consistency static shunt mixes which must be introduced by injection molding techniques or other techniques suitable for handling pastes.

The present static discharge disc satisfies the need for static discharge device and associated EED which have a high degree of reliability, high dielectric strength, ease of assembly, and low cost.

Electroexplosive devices incorporating a static discharge element as shown and described herein are particularly useful as initiators for passive restraint devices, popularly known as airbags, for automobiles. One of the requirements for an EED in this service is that the EED shall not function once subjected to the discharge from a 500 picofarad capacitor charged to 25,000 volts, the discharge being applied from the leads (which are connected together) to the casing through a series resistance of 5,000 ohms. The electroexplosive devices incorporating the discharge disc herein are capable of meeting that requirement.

The igniter shown in FIGS. 1 and 2 also possesses advantages not found in prior art devices. First of all, the ignitor herein will not fire or be degraded by discharges from a 500 picofarad capacitor charged to 25,000 volts, when fired through a 5,000 ohm resistor either pin to pin or pin to case. This advantage accrues primarily as result of using the static discharge disc shown in FIGS. 3 and 4.

The igniter of FIGS. 1 and 2 also possesses all of the other advantages stated above which result from the use of the static discharge disc shown herein.

The igniter herein is also capable of meeting an all-fire requirement of 3.5 amp. and a 3 milisecond pulse, and a no-fire requirement of 0.75 amp. for 10 seconds minimum. Also, the igniter herein has an after fire resistance of 1,000 ohms minimum pin-to-pin and pin-to-case at 24 volts dc, measured from 1 to 200 ms after application of a 3.0 ms firing pulse.

The igniter herein also has good RF attenuation. The igniter will not fire when RF power is delivered as follows: 4.0 watts at a frequency from 10 MHz to 12 GHz; or 2.0 watts at 5 MHz; or 0.5 watts at 1 MHz. Much better results in both pin-to-pin and pin-to-case test modes have been achieved.

The present igniter structure also assures good electrical contact between the ferrite sleeve and the casing, and insulation between the ferrite sleeve and the lead wires.

A futher advantage of the igniter herein is that good RF protection is achieved with the ferrite sleeve alone, without possibility of current flow through the ferrite sleeve under normal conditions, by virture of good electrical contact between the ferrite sleeve and the casing and insulation between the ferrite sleeve and the lead.

A further advantage of the igniter herein is that, by using both the ferrite sleeve and the static discharge element shown and described herein, good RF protection and good electrostatic protection are achieved in a compact EED.

Various modifications in addition to those previously mentioned can be made without departing from the scope of this invention. For example, an EED according to this invention may have either 1, 2, or 4 lead wires, and the static discharge disc will be shaped accordingly. In all cases the inner boundary of the copper layer on the static discharge disc will be close to but spaced from the edge of the opening for the lead wire or wires. One lead devices are those in which there is an electrical connection from the bridge element to a grounded metallic casing, as is well known in the art.

I claim:

1. An electroexplosive device comprising:

(a) an electrically conductive casing having an opening therein;

(b) a heat ignitable charge in said casing;

(c) means for igniting said charge including a bridge element in proximity with said charge and conductor means comprising at least one lead for supplying an electric current to said bridge element;

(d) a static discharge element for preventing accidental electrostatic discharge of said device, said element comprising a nonconductive substrate having an opening therein to permit said conductor means to extend therethrough, a thin electrically conductive layer covering a portion of at least one face of said substrate, said conductive layer being in electrical contact with said casing but out of contact with said opening means and said conductor means, said conductive layer have a boundary, a portion of which is disposed in proximity with but entirely out of contact with the adjacent edge of said opening, whereby a spark gap is provided between said lead wires and said conductive member; and (e) a ferrite sleeve having opening means extending longitudinally therethrough to permit said conductor means to extend therethrough, means for insulating the sleeve from said conductor means, and means for providing electrical contact between the sleeve and the casing.

2. An electroexplosive device according to claim 1 in which said means for insulating said sleeve from said conductor means comprises a coating of an electrically nonconductive thermoplastic material on the walls of said ferrite sleeve.

3. An electroexplosive device according to claim 2 in which said thermoplastic material is polymonochloroparaxylylene.

4. An electroexplosive device according to claim 1 including a base charge of igniter material in proximity with said heat ignitable charge.

5. An electroexplosive device according to claim 1 in which said casing is cylindrical, closed at one end and open at the other end; said open end forming said opening, and in which said static discharge element is a disc.

6. An electroexplosive device according to claim 5 having a pair of lead wires and in which said opening means in said ferrite sleeve comprises a pair of longitudinal openings.

7. An electroexplosive device according to claim 6 in which said static discharge disc is disposed between said bridge element and the open end of said casing.

8. An electroexplosive device according to claim 7 in which said ferrite sleeve is disposed between said static discharge disc and the open end of said casing.

9. An electroexplosive device according to claim 1 in which said static discharge element has electrically conductive layers covering portions of both faces of said substrate.

* * * * *